US009551494B2

(12) United States Patent
Zehr

(10) Patent No.: US 9,551,494 B2
(45) Date of Patent: Jan. 24, 2017

(54) MOUNTING BRACKET WITH THERMAL MAZE TO REDUCE HEAT TRANSFER RATE

(71) Applicant: General Electric Company, Schenectady, NY (US)

(72) Inventor: Edwin Glenn Zehr, Sugar Valley, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 379 days.

(21) Appl. No.: 14/220,236

(22) Filed: Mar. 20, 2014

(65) Prior Publication Data

US 2015/0267921 A1 Sep. 24, 2015

(51) Int. Cl.

| | |
|---|---|
| ***F24C 15/32*** | (2006.01) |
| ***F04D 29/60*** | (2006.01) |
| ***F04D 29/58*** | (2006.01) |

(52) U.S. Cl.

CPC ..... *F24C 15/322* (2013.01); *F04D 29/5853* (2013.01); *F04D 29/601* (2013.01)

(58) Field of Classification Search

CPC ..... F04D 29/5853; F04D 29/601

See application file for complete search history.

(56) References Cited

U.S. PATENT DOCUMENTS 2,142,307 A * 1/1939 De Mey ..... F04D 29/646 415/119
3,317,124 A * 5/1967 Morrill ..... F04D 29/646 156/169
3,506,226 A * 4/1970 Blomgren ..... F16F 15/073 248/604
3,707,145 A * 12/1972 Anetsberger ..... F24C 15/322 126/197
4,200,257 A * 4/1980 Litch, III ..... F04D 29/282 248/604
4,805,868 A * 2/1989 Claude ..... F01P 5/04 165/122
5,203,315 A * 4/1993 Clawson ..... F24C 15/322 126/19 R
5,385,026 A * 1/1995 Zhang ..... F17C 13/083 62/50.7
5,420,393 A * 5/1995 Dornbush ..... A23L 3/40 219/386
5,786,567 A * 7/1998 Wang ..... F24C 15/322 126/21 A
5,792,539 A * 8/1998 Hunter ..... B32B 3/28 428/178

(Continued)

FOREIGN PATENT DOCUMENTS

| | | |
|---|---|---|
| DE | 10229630 | 1/2004 |
| FR | 2791192 | 9/2000 |
| WO | WO 2009083360 A2 | 7/2009 |

*Primary Examiner* — Kenneth Rinehart
*Assistant Examiner* — Logan Jones
(74) *Attorney, Agent, or Firm* — Dority & Manning, P.A.

(57) ABSTRACT

The present invention provides an oven appliance with a bracket for attaching a component such as a fan motor to the oven appliance. One or more features are provided for minimizing the transfer of heat from the oven appliance, through the bracket, to the component. In certain embodiments, a bracket having a plurality of bracket attachment elements, a plurality of motor attachment elements, and a plurality of slots is configured to define a nonlinear path for the transfer of heat from the oven appliance to the fan motor.

20 Claims, 8 Drawing Sheets

(56) References Cited

U.S. PATENT DOCUMENTS

| | | | | |
|---|---|---|---|---|
| 6,454,530 | B1 * | 9/2002 | Lange | F04D 25/06 415/177 |
| 7,992,552 | B2 * | 8/2011 | Hirano | F24C 15/322 126/21 A |
| 2004/0231090 | A1 * | 11/2004 | Kushida | A47L 5/22 15/326 |
| 2005/0098047 | A1 * | 5/2005 | Steinberg | F24C 15/16 99/450 |
| 2009/0045184 | A1 * | 2/2009 | Nam | F24C 15/322 219/400 |

* cited by examiner

MOUNTING BRACKET WITH THERMAL MAZE TO REDUCE HEAT TRANSFER RATE

FIELD OF THE INVENTION

The subject matter of the present disclosure relates generally to bracket for attaching a component to an oven appliance and reducing heat transfer to the component.

BACKGROUND OF THE INVENTION

Oven appliances generally include a cabinet with a cooking chamber positioned in the cabinet. Certain oven appliances may also include features for forcing movement of heated air within the cooking chamber. Such oven appliances are generally referred to as convection ovens. The forced air movement can improve e.g., the uniformity and rate of cooking of the food.

In typical convection ovens, heated air within the cooking chamber can be circulated with a fan when in the convection mode. The fan motor is supported by an exterior wall of the cooking chamber, and the fan, connected to the fan motor by a shaft, is located at the cooking chamber. Because the fan motor is supported by an exterior wall of the cooking chamber, the fan motor can be exposed to temperatures, e.g., during the convection mode or the self-cleaning mode, that may damage the fan motor. Similarly, other components supported by the oven appliance may be exposed to detrimental temperatures.

Accordingly, an oven appliance with features for minimizing heat transfer from the oven appliance to heat sensitive components would be useful. In particular, a bracket for an oven appliance that can support a component such as e.g., fan along an oven wall while minimizing heat transfer to the component would be beneficial.

BRIEF DESCRIPTION OF THE INVENTION

The present invention provides an oven appliance with a bracket for attaching a component such as a fan motor to the oven appliance. One or more features are provided for minimizing the transfer of heat from the oven appliance, through the bracket, to the component. In certain embodiments, a bracket having a plurality of bracket attachment elements, a plurality of motor attachment elements, and a plurality of slots is configured to define a nonlinear path for the transfer of heat from the oven appliance to the fan motor. Additional aspects and advantages of the invention will be set forth in part in the following description, may be apparent from the description, or may be learned through practice of the invention.

In a first exemplary embodiment, an oven appliance includes a cabinet defining a cooking chamber configured for receipt of food items for cooking, and the cooking chamber has an exterior wall. The oven appliance also includes a heating element configured to heat the cooking chamber; a fan positioned at the cooking chamber and configured for creating an air flow in the cooking chamber; and a fan motor connected to the fan by a shaft. Additionally, the oven appliance includes a bracket supported upon the exterior wall. The bracket has a body portion defining a plane, and the fan motor is supported by the body portion of the bracket. The bracket includes a plurality of bracket attachment elements projecting from the body portion toward the exterior wall and configured for attaching the bracket to the exterior wall of the cooking chamber, and each bracket attachment element has a plurality of discrete contact members providing the only contact between the bracket and the exterior wall of the cooking chamber. The bracket also includes a plurality of motor attachment elements, and each motor attachment element projects from the body portion toward the fan motor and provides the only contact between the motor and the body portion. The bracket further includes a plurality of slots defined within the plane of the body portion of the bracket, wherein a straight line constructed within the plane between any one of the motor attachment elements and any one of the bracket attachment elements is intersected by at least one slot of the plurality of slots.

In a second exemplary embodiment, an oven appliance includes a cabinet defining a cooking chamber configured for receipt of food items for cooking, and the cooking chamber has an exterior wall. The oven appliance also includes a heating element configured to heat the cooking chamber; a fan positioned at the cooking chamber and configured for creating an air flow in the cooking chamber; and a fan motor connected to the fan by a shaft. Additionally, the oven appliance includes a bracket supported upon the exterior wall. The bracket has a body portion defining a plane, and the fan motor is supported by the body portion of the bracket. The bracket includes a plurality of bracket attachment elements projecting from the body portion toward the exterior wall and configured for attaching the bracket to the exterior wall of the cooking chamber, and each bracket attachment element has a plurality of discrete contact members providing the only contact between the bracket and the exterior wall of the cooking chamber. The bracket also includes a plurality of motor attachment elements, and each motor attachment element projects from the body portion toward the fan motor and provides the only contact between the motor and the body portion. The bracket further includes a plurality of slots defined within the plane of the body portion of the bracket, wherein the plurality of slots form two circuits of slots; each circuit surrounds the plurality of motor attachment elements; each pair of adjacent slots within a circuit is separated by a gap; and any straight line constructed within the plane between any one of the motor attachments elements and any one of the bracket attachment elements will not intersect more than one gap.

In a third exemplary embodiment, a bracket for supporting a component on the exterior wall of an oven appliance includes a body portion defining a plane, and the body portion supports the component. The bracket also includes a plurality of bracket attachment elements projecting from the body portion toward the exterior wall of the oven appliance. The bracket attachment elements are configured for attaching the bracket to the exterior wall, and each bracket attachment element has a plurality of discrete contact members that provide the only contact between the bracket and the exterior wall. The bracket also includes a plurality of component attachment elements; each component attachment element projects from the body portion toward the component and provides the only contact between the component and the body portion. The bracket further includes a plurality of slots defined within the plane of the body portion of the bracket, wherein a straight line constructed within the plane between any one of the component attachment elements and any one of the bracket attachment elements is intersected by at least one slot of the plurality of slots.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same reference numerals in different figures denotes the same or similar features.

DETAILED DESCRIPTION OF THE INVENTION

Figure 1:
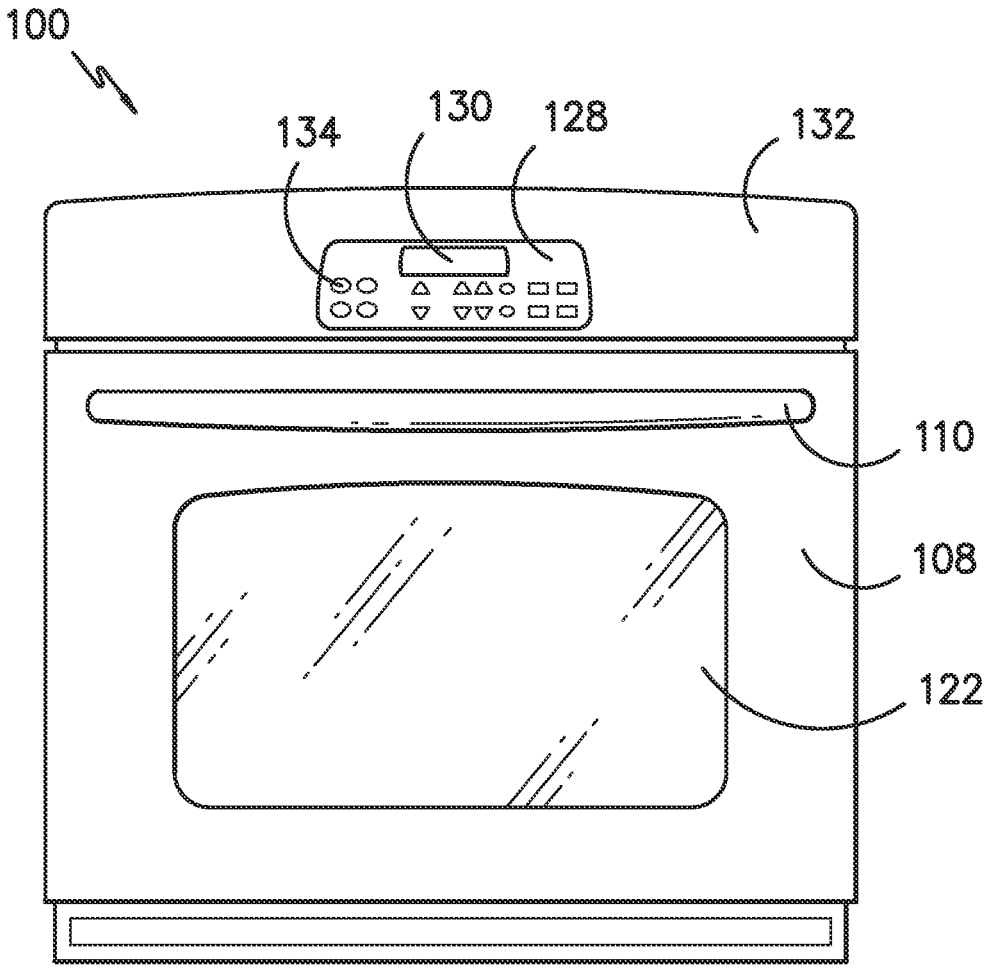
FIG. 1 provides a front view of an exemplary embodiment of an oven appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
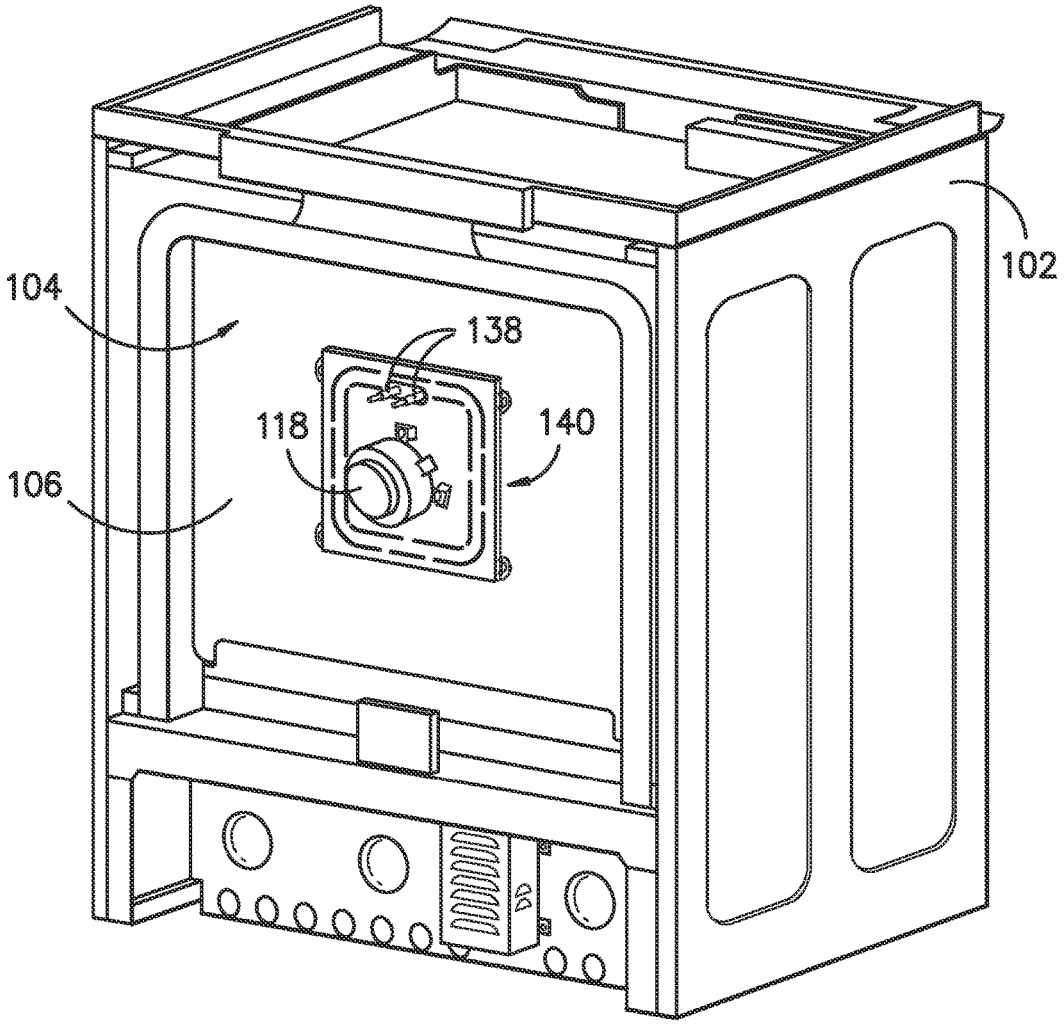
FIG. 2 provides a perspective view of the back of the oven appliance of FIG. 1 with an exemplary bracket mounted to the oven appliance.

Referring to FIGS. 1 and 2, for this exemplary embodiment, oven appliance 100 includes an insulated cabinet 102 with an interior cooking chamber 104 having exterior wall 106. Cooking chamber 104 is configured for the receipt of one or more food items to be cooked. Oven appliance 100 includes a door 108 rotatably mounted, e.g., with one or more hinges (not shown), to cabinet 102 to permit selective access to cooking chamber 104. A handle 110 is mounted to door 108 and assists a user with opening and closing door 108. For example, a user can pull on handle 110 to open or close door 108 and access cooking chamber 104.

Oven appliance 100 can include a seal (not shown) between door 108 and cabinet 102 that assists with maintaining heat and cooking fumes within cooking chamber 104 when door 108 is closed as shown in FIGS. 1 and 2. Multiple parallel glass panes 122 provide for viewing the contents of cooking chamber 104 when door 108 is closed and assist with insulating cooking chamber 104. A heating element 112 (FIG. 4) at the top, bottom, or both of cooking chamber 104 provides heat to cooking chamber 104 for cooking. Such heating element(s) 112 can be gas, electric, microwave, or a combination thereof.

Oven appliance 100 includes a user interface 128 having a display 130 positioned on an interface panel 132 and having a variety of controls 134. Interface 128 allows the user to select various options for the operation of oven 100 including, e.g., temperature, time, and/or various cooking and cleaning cycles. Operation of oven appliance 100 can be regulated by a controller (not shown) that is operatively coupled, i.e., in communication with, the user interface 128 and other components of oven 100 as will be further described.

For example, in response to user manipulation of the user interface 128, the controller can operate the heating element (s) 112. The controller can receive measurements from a temperature sensor (not shown) placed in cooking chamber 104 and, e.g., provide a temperature indication to the user with display 130. The controller can also be provided with other features as will be further described herein.

By way of example, the controller may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor.

The controller may be positioned in a variety of locations throughout oven appliance 100. In the illustrated embodiment, the controller may be located under or next to the user interface 128 otherwise within interface panel 132. In such an embodiment, input/output ("I/O") signals are routed between the controller and various operational components of oven appliance 100 such as controls 134, display 130, heating elements 112, alarms, and/or other components as may be provided. In one embodiment, the user interface 128 may represent a general purpose I/O ("GPIO") device or functional block.

Although shown with touch type controls 134, it should be understood that controls 134 and the configuration of oven appliance 100 shown in FIG. 1 is provided by way of example only. More specifically, user interface 128 may include various input components, such as one or more of a variety of electrical, mechanical, or electro-mechanical input devices including rotary dials, push buttons, and touch pads. The user interface 128 may include other display components, such as a digital or analog display device designed to provide operational feedback to a user. The user interface 128 may be in communication with the controller via one or more signal lines or shared communication busses.

Also, oven 100 is shown as a wall oven, but the present invention could also be used with other cooking appliances such as, e.g., a stand-alone oven, an oven with a stove-top, or other configurations of such ovens.

Figure 3:
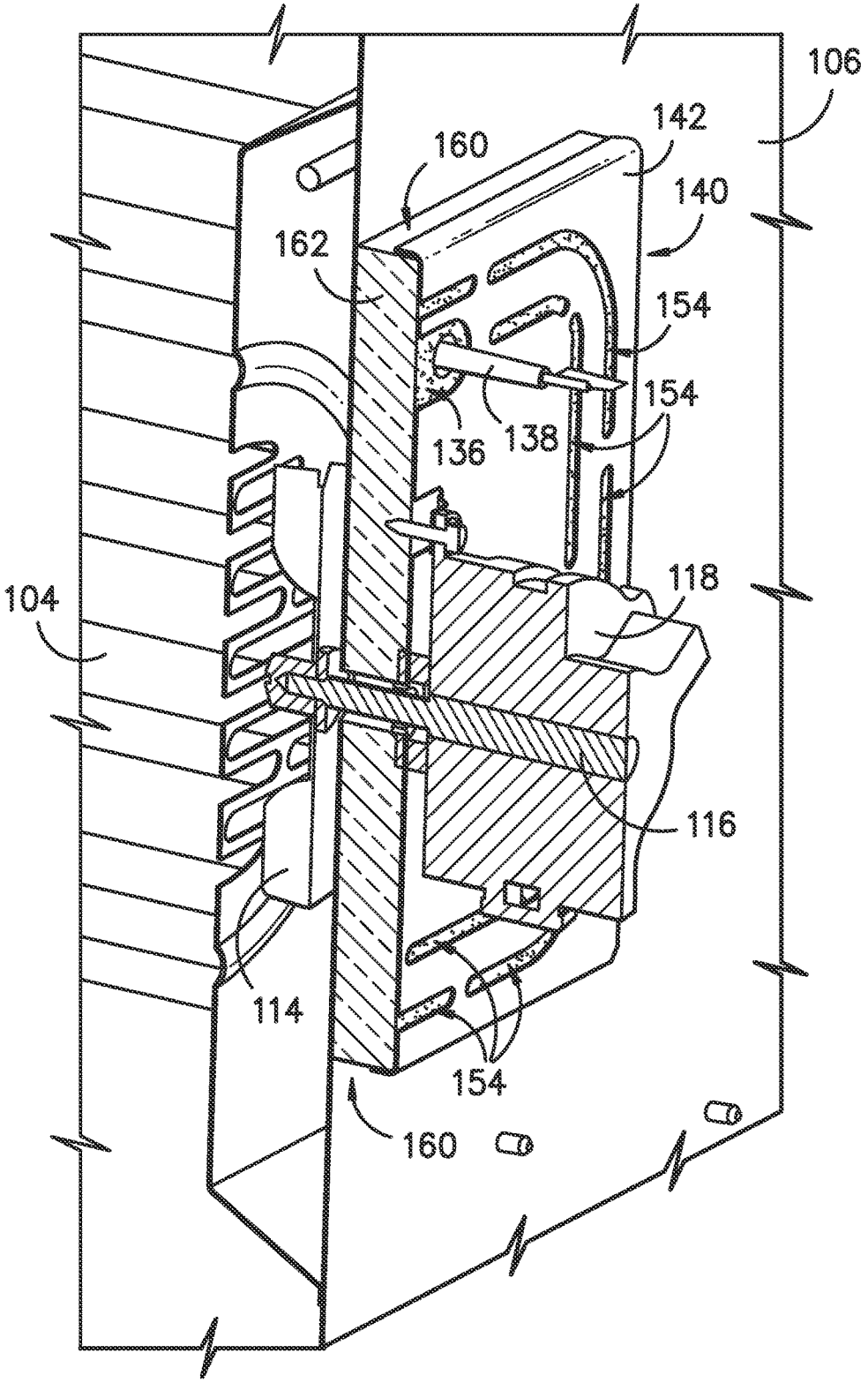
FIG. 3 provides a perspective cross-sectional view of the exemplary bracket and back of the oven appliance of FIG. 2.
Figure 4:
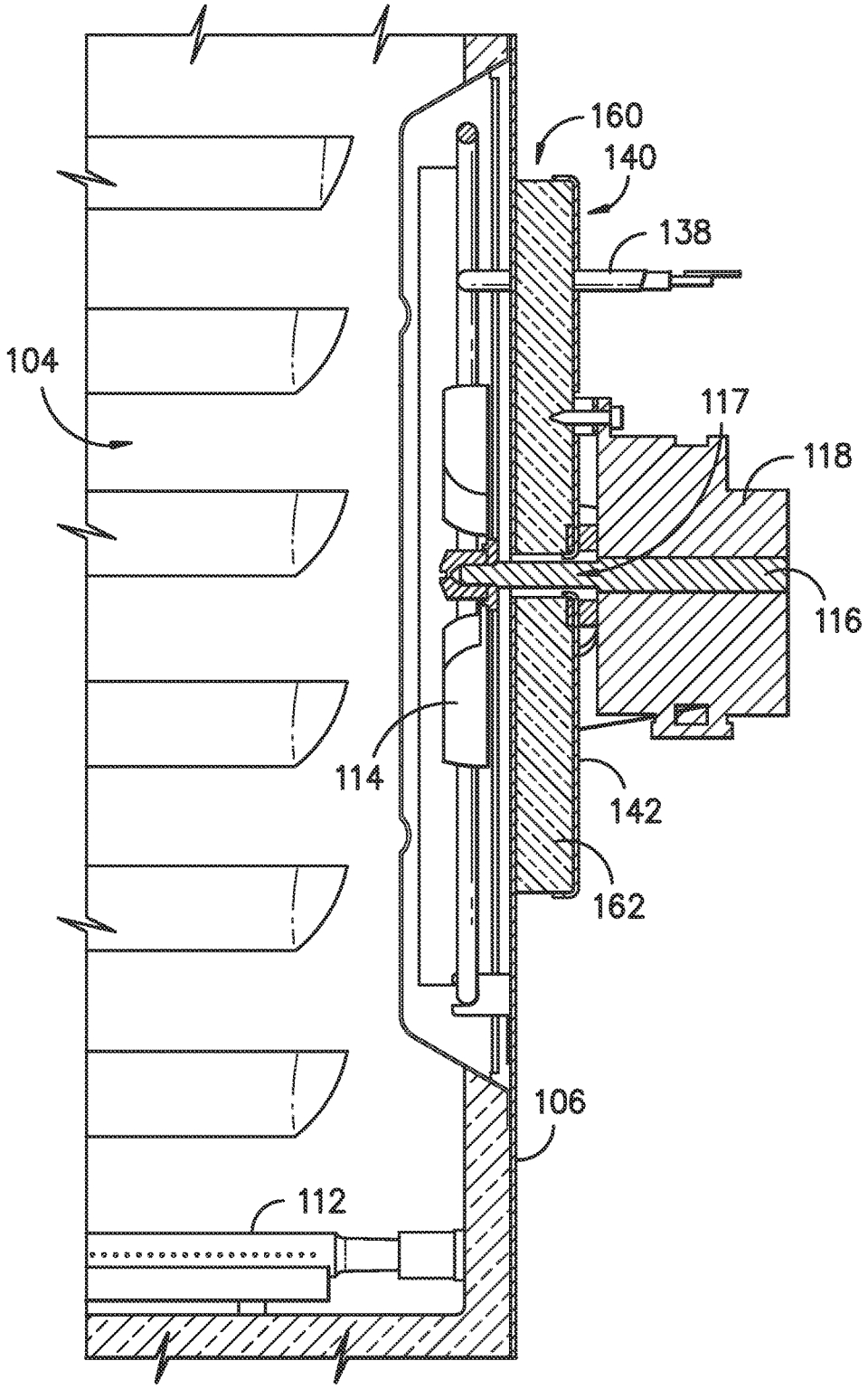
FIG. 4 provides a cross-sectional view of the exemplary bracket and oven appliance of FIG. 2.

As shown in FIG. 2, a bracket 140 may be used to support convection fan motor 118 on the exterior wall 106 of cooking chamber 104. Referring now to FIGS. 3 and 4, convection fan 114 is positioned within cooking chamber 104 for use during, e.g., convection modes of oven appliance 100. Fan 114 is connected to fan motor 118 by a shaft 116 extending through shaft opening 117 in bracket 140. Fan motor 118 may be an open coil motor or any other suitable device for driving fan 114. It should be understood that the present invention may be used to mount other components to oven appliance 100, such as, e.g., the controller or any other heat-sensitive component. Further, in alternative embodiments, fan 114 may be positioned in other locations with respect to cooking chamber 104.

As illustrated in FIG. 2, bracket 140 is supported on exterior wall 106 of cooking chamber 104. By way of example, bracket 140 may be may be connected, fixed, or coupled to exterior wall 106 using appropriate fasteners, e.g., screws or the like, or using any suitable mechanism. As shown in FIGS. 3 and 4, bracket 140 includes an opening 136 for electrodes 138. Bracket 140 may include other such openings or the like to accommodate various features of oven appliance 100.

During operation of oven appliance 100, e.g., during convection or self-clean modes, high temperatures may be generated in cooking chamber 104, and heat from cooking chamber 104 may be conducted through exterior wall 106, which could be detrimental to components, such as, e.g., fan motor 118, mounted on or in thermal contact with exterior wall 106. The inventor has discovered that configuring bracket 140 to define a nonlinear path, or a thermal maze, through which conduction must occur from exterior wall 106 to fan motor 118 can reduce the rate of heat transfer to fan motor 118 and protect fan motor 118 from damaging temperatures.

Figure 5:
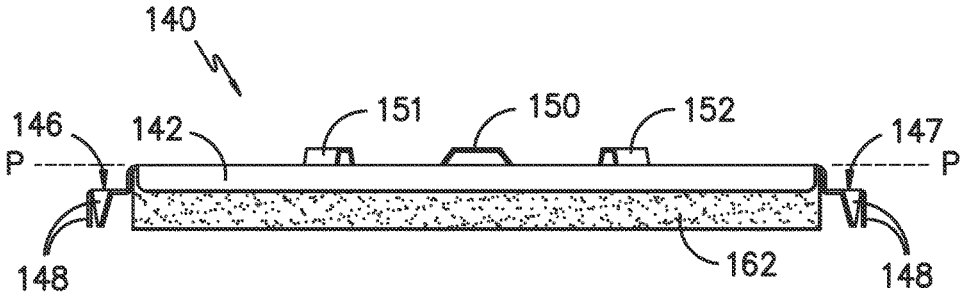
FIG. 5 provides a side view of the exemplary bracket of FIG. 2.
Figure 6:
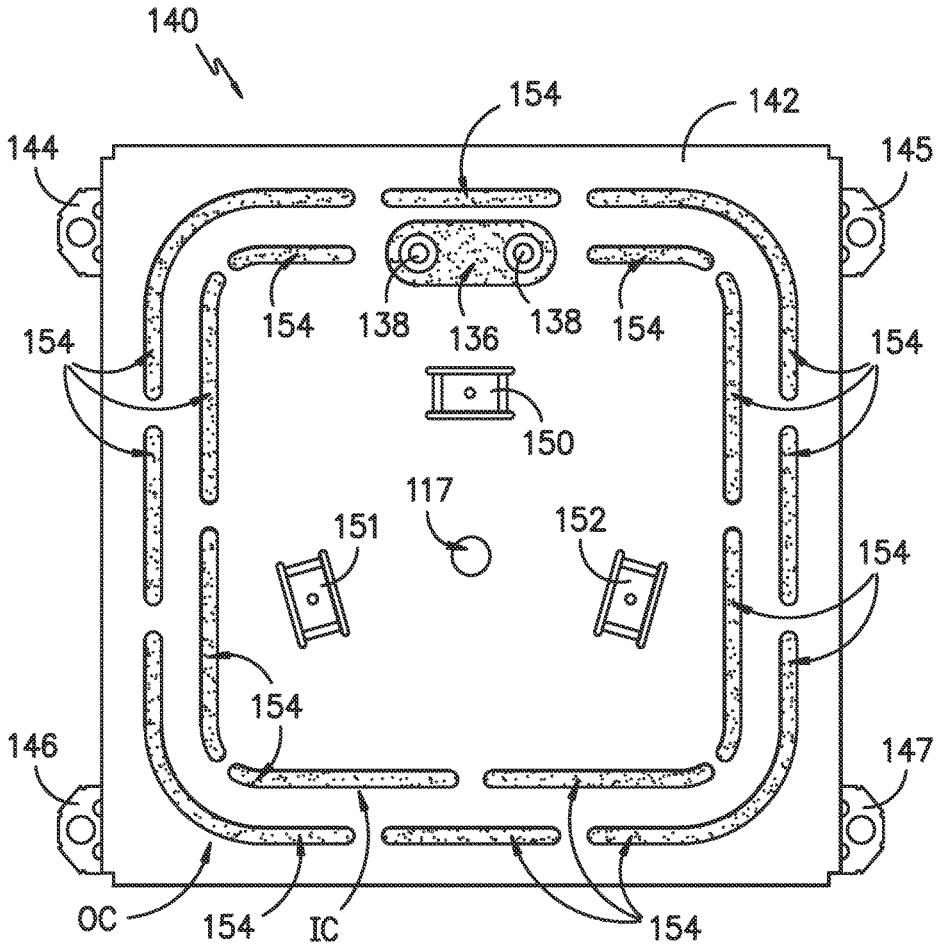
FIG. 6 provides a top view of the exemplary bracket of FIG. 2.

Referring now to FIGS. 5 and 6, bracket 140 includes a body portion 142 that defines a plane P. Body portion 142 is spaced from exterior wall 106 by an air gap 160. Insulation 162 may be placed in air gap 160 between exterior wall 106 and body portion 142. Insulation 162 may be a block of insulation material or any other suitable form of insulation to impede the transfer of heat from exterior wall 106 to bracket 140.

Bracket 140 also includes a plurality of bracket attachment elements 144, 145, 146, 147 for attaching bracket 140 to exterior wall 106. Bracket attachment elements 144, 145, 146, 147 project from body portion 142 toward exterior wall 106. Bracket attachment elements 144, 145, 146, 147 may be formed as part of body portion 142 or may be formed as separate elements that are attached to body portion 142 using any suitable mechanism. Additionally, while bracket 140 is illustrated as having four bracket attachment elements 144, 145, 146, 147, any suitable number of bracket attachment elements may be used. Moreover, in alternative embodiments of the invention, bracket attachment elements may be positioned in different locations with respect to body portion 142 from those shown, e.g., in FIG. 6.

Further, for this exemplary embodiment, each bracket attachment element 144, 145, 146, 147 has a plurality of discrete contact members 148 that provide the only contact between bracket 140 and exterior wall 106. Each contact member 148 is triangle-shaped and has a single point of contact with exterior wall 106 to minimize the rate of heat transfer from exterior wall 106 to bracket 140 and fan motor 118. Other shapes and configurations of contact members 148 may be used as well. For example, each bracket attachment element 144, 145, 146, 147 is illustrated with three contact members 148, but in alternative embodiments, one, two, or four or more contact members 148 may be used.

Bracket 140 also includes a plurality of motor attachment elements 150, 151, 152 for attaching fan motor 118 to bracket 140. Motor attachment elements 150, 151, 152 project from body portion 142 toward fan motor 118 and, for this exemplary embodiment, provide the only point of contact between fan motor 118 and body portion 142. Although motor attachment elements 150, 151, 152 are illustrated in the exemplary embodiments as being formed from body portion 142, motor attachment elements 150, 151, 152 may be formed as separate elements that are attached to body portion 142 using any suitable mechanism. In addition, while bracket 140 is illustrated as having three motor attachment elements 150, 151, 152, any suitable number of motor attachment elements may be used. Moreover, fan motor 118 may be connected, fixed, or coupled to motor attachment elements 150, 151, 152 using appropriate fasteners, e.g., screws or the like, or using any suitable mechanism.

Figure 7:
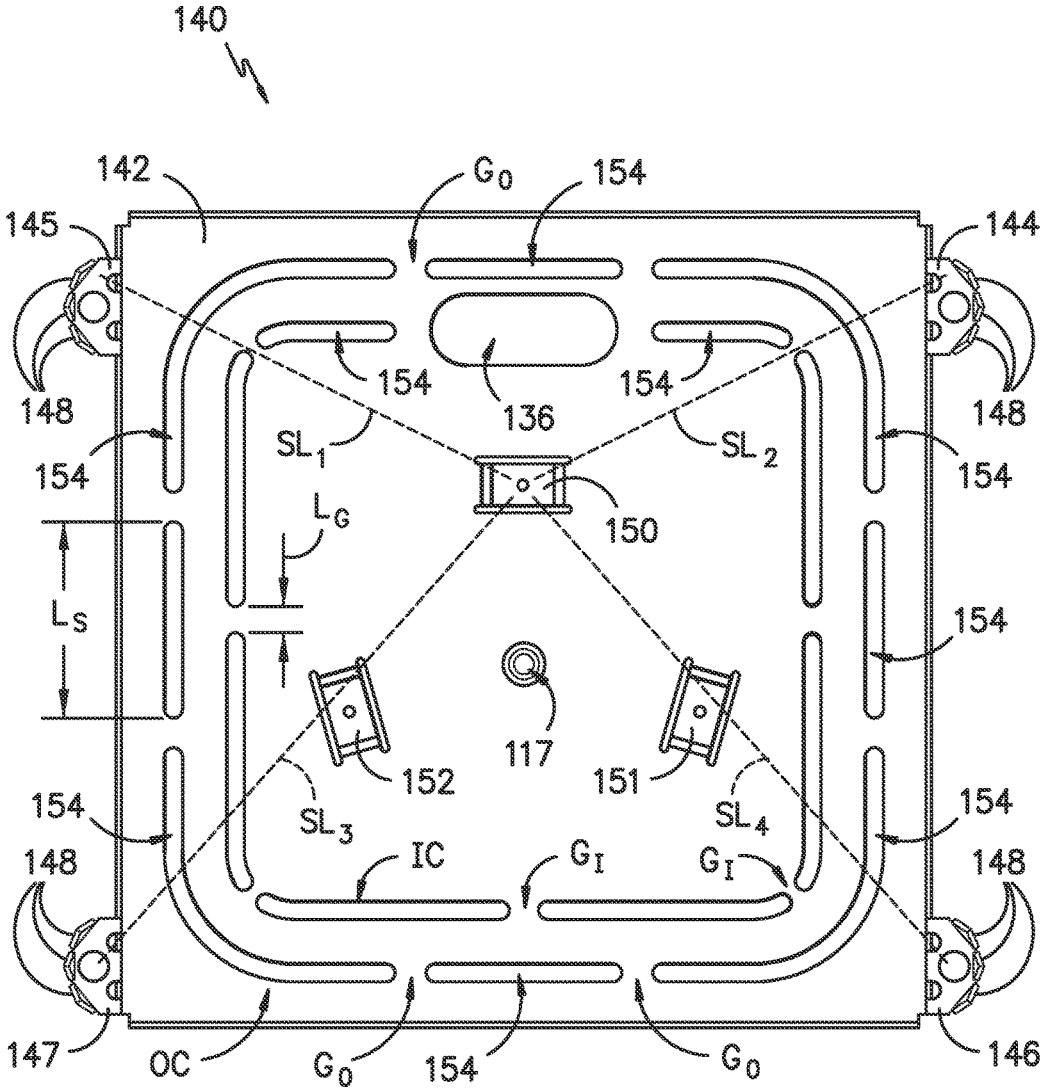
FIG. 7 provides a bottom view of the exemplary bracket of FIG. 2.
Figure 8:
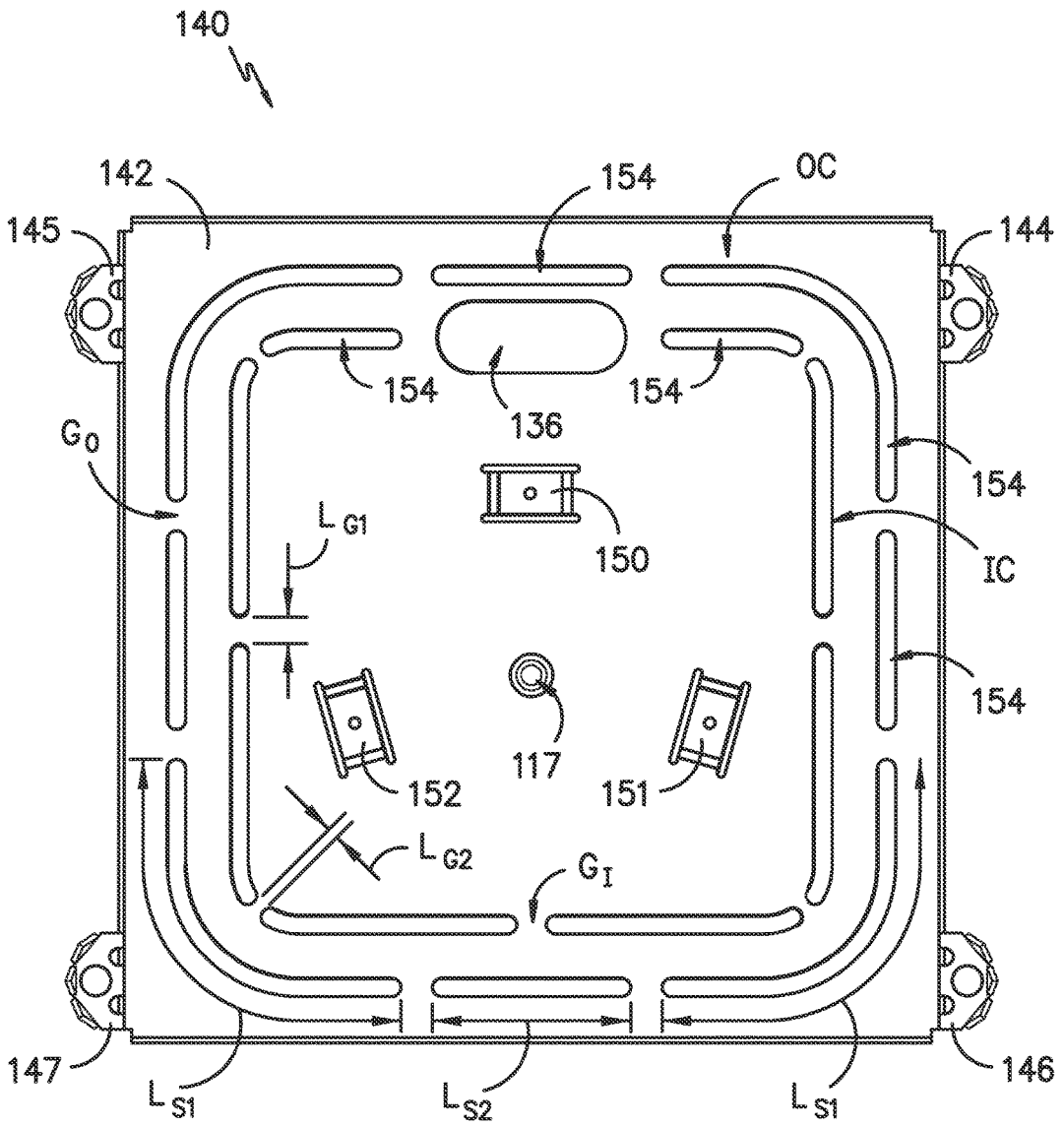
FIG. 8 provides another bottom view of the exemplary bracket of FIG. 2.

Body portion 142 of bracket 140 defines a plurality of slots 154 within plane P. Referring now to FIGS. 7 and 8, the plurality of slots 154 are arranged in two circuits of slots 154, an outer circuit OC and an inner circuit IC. Outer circuit OC surrounds inner circuit IC, and outer circuit OC and inner circuit IC each surround motor attachment elements 150, 151, 152. Each pair of slots 154 in outer circuit OC forms an outer circuit gap $G_O$, and each pair of slots 154 in inner circuit IC forms an inner circuit gap $G_I$. For this exemplary embodiment, no gap $G_O$ is adjacent to any gap $G_I$ within the plane P of body portion 142. In other embodiments, the plurality of slots 154 may be differently arranged, e.g., in one circuit or more than two circuits, and/or slots 154 may be arranged without forming a circuit.

Each gap $G_O$, $G_I$ has a length $L_G$. Some gaps $G_O$, $G_I$ may have the same length $L_G$ or may be of different lengths $L_G$. Further, each slot 154 has a length $L_S$. Some slots 154 may have the same length $L_S$ or may be of different lengths $L_S$. As an example, FIG. 8 illustrates gaps $G_I$ of lengths $L_{G1}$ and $L_{G2}$ and slots 154 of lengths $L_{S1}$ and $L_{S2}$. In this exemplary embodiment, each gap length $L_G$ is shorter than each slot length $L_S$. In certain embodiments, a given gap length $L_G$ may be in the range of about 10% to about 30% of a given slot length $L_S$. Other gap lengths $L_G$ may also be used.

Moreover, slots 154 are arranged such that a straight line SL constructed within plane P between any one of motor attachment elements 150, 151, 152 and any one of bracket attachment elements 144, 145, 146, 147 intersects at least one slot 154. In another exemplary embodiment, at least two slots 154 will be intersected by straight line SL. By way of example, as shown in FIG. 7, straight line $SL_1$ constructed between motor attachment element 150 and bracket attachment element 145 intersects one gap $G_I$ and one slot 154. Straight line $SL_2$ constructed between motor attachment element 150 and bracket attachment element 144 intersects one gap $G_I$ and one slot 154. Straight line $SL_3$ constructed between motor attachment element 150 and bracket attachment element 147 intersects two slots 154, and straight line $SL_4$ constructed between motor attachment element 150 and bracket attachment element 146 intersects two slots 154. Similar lines could be drawn for the other motor attachment elements 151 and 152.

In alternative embodiments, slots 154 may be arranged such that any straight line (such as, e.g., $SL_1$ or $SL_2$) constructed within plane P between any one of motor attachment elements will not intersect more than one gap $G_O$ or $G_I$. In still another embodiment, slots 154 are arranged such that any straight line (such as, e.g., $SL_3$ or $SL_4$) constructed within plane P will not intersect any gaps.

Figure 9:
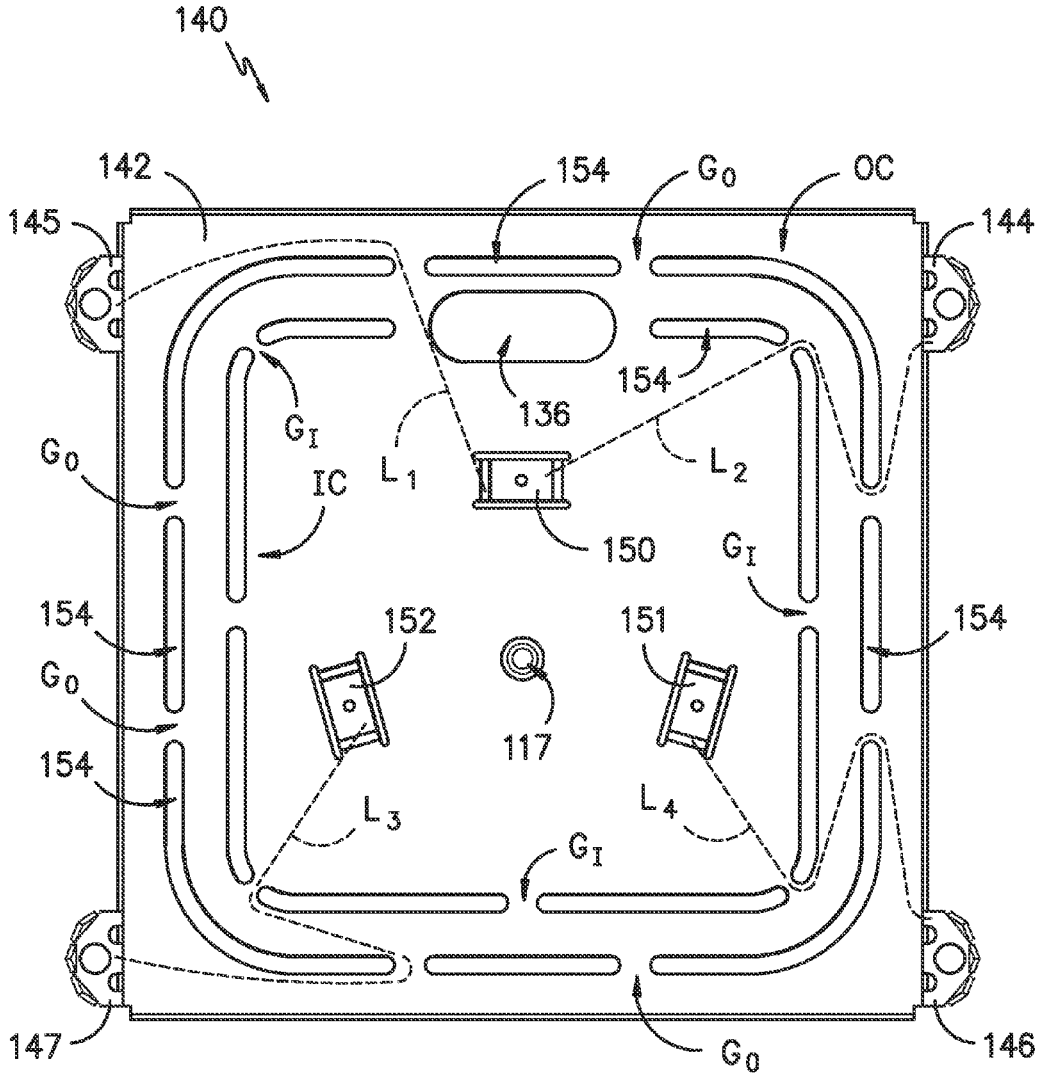
FIG. 9 provides an alternative bottom view of the exemplary bracket of FIG. 2.

As shown in FIG. 9, the arrangement of contact members 148, bracket attachment elements 144, 145, 146, 147, motor attachment elements 150, 151, 152, and slots 154 (with gaps $G_O$ between adjacent pairs of slots 154 in outer circuit OC and gaps $G_I$ between adjacent pairs of slots 154 in inner circuit IC) defines a nonlinear path for the transfer of heat from exterior wall 106 to fan motor 118. In the exemplary embodiment of FIG. 9, motor attachment elements 150, 151, 152, slots 154, and bracket attachment elements 144, 145, 146, 147 are arranged such that any line L constructed within plane P of body portion 142 between any one of the motor attachment elements 150, 151, 152 and any one of the bracket attachment elements 144, 145, 146, 147 that does not intersect any slot 154 includes at least one change in direction. For example, as shown in FIG. 9, line $L_1$ constructed between motor attachment element 150 and bracket attachment element 145 includes one change in direction. Line $L_2$ constructed between motor attachment element 150 and bracket attachment element 144 includes two changes in direction. Line $L_3$ constructed between motor attachment element 152 and bracket attachment element 147 includes two changes in direction. Line $L_4$ constructed between motor attachment element 151 and bracket attachment element 146 includes two changes in direction. Alternatively, motor attachment elements 150, 151, 152, slots 154, and bracket attachment elements 144, 145, 146, 147 may be arranged such that any line L constructed within plane P of body portion 142 between any one of the motor attachment elements 150, 151, 152 and any one of the bracket attachment elements 144, 145, 146, 147 that does not intersect any slot 154 includes at least two changes in direction. Other configurations of bracket 140 may also be used to create a thermal maze and lengthen the path for heat transfer from exterior wall 106 to fan motor 118 to protect fan motor 118 from the high temperatures generated within cooking chamber 104 of oven appliance 100.

Accordingly, by configuring bracket 140 as described, the length of the path for heat transfer by conduction from the oven to motor 118 is increased in a manner that can reduce the amount of heat transferred to motor 118 or another heat sensitive component supported by bracket 140.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An oven appliance, comprising:

a cabinet defining a cooking chamber configured for receipt of food items for cooking, the cooking chamber having an exterior wall;

a heating element configured to heat the cooking chamber;

a fan positioned at the cooking chamber and configured for creating an air flow in the cooking chamber;

a fan motor connected to the fan by a shaft; and a bracket supported upon the exterior wall, the bracket having a body portion defining a plane, the fan motor supported by the body portion of the bracket, the bracket comprising a plurality of bracket attachment elements projecting from the body portion toward the exterior wall and configured for attaching the bracket to the exterior wall of the cooking chamber, each bracket attachment element having a plurality of discrete contact members providing the only contact between the bracket and the exterior wall of the cooking chamber, the discrete contact members spacing the body portion of the bracket from the exterior wall;

a plurality of motor attachment elements integral with the body portion, each motor attachment element projecting from the body portion toward the fan motor, each motor attachment element providing the only contact between the fan motor and the body portion; and a plurality of slots defined within the plane of the body portion of the bracket, wherein a straight line constructed within the plane between any one of the motor attachment elements and any one of the bracket attachment elements is intersected by at least one slot of the plurality of slots.

2. The oven appliance of claim 1, wherein the plurality of slots form two circuits of slots, wherein each circuit surrounds the plurality of motor attachment elements.

3. The oven appliance of claim 2, wherein each pair of adjacent slots within a circuit is separated by a gap that is shorter in length than either of the adjacent slots.

4. The oven appliance of claim 1, wherein the plurality of slots form an outer circuit of slots and an inner circuit of slots that is surrounded by the outer circuit of slots, wherein each pair of adjacent slots within the outer circuit forms an outer circuit gap and each pair of adjacent slots of the inner circuit forms an inner circuit gap, wherein at least a portion of the gaps of the outer circuit and gaps of the inner circuit are not adjacent within the plane of the body portion of the bracket.

5. The oven appliance of claim 1, wherein the plurality of slots form two circuits of slots, wherein each circuit surrounds the plurality of motor attachment elements, wherein each pair of adjacent slots within a circuit is separated by a gap that is shorter in length than either of the adjacent slots, wherein any straight line constructed within the plane between any one of the motor attachments elements and any one of the bracket attachment elements will not intersect more than one gap.

6. The oven appliance of claim 1, wherein the exterior wall and body portion define an air gap.

7. The oven appliance of claim 6, wherein a block of insulation is positioned in the air gap.

8. The oven appliance of claim 1, wherein the contact members are triangle-shaped and have a single point of contact with the exterior wall.

9. The oven appliance of claim 8, wherein each bracket attachment element has three contact members.

10. The oven appliance of claim 1, wherein any line constructed within the plane between any one of the motor attachment elements and any one of the bracket attachment elements that does not intersect any slot of the plurality of slots comprises at least one change in direction.

11. The oven appliance of claim 1, wherein any straight line constructed within the plane between any one of the motor attachment elements and any one of the bracket attachment elements is intersected by at least one slot of the plurality of slots.

12. An oven appliance, comprising:

a cabinet defining a cooking chamber configured for receipt of food items for cooking, the cooking chamber having an exterior wall;

a heating element configured to heat the cooking chamber;

a fan positioned at the cooking chamber and configured for creating an air flow in the cooking chamber;

a fan motor connected to the fan by a shaft; and a bracket supported upon the exterior wall, the bracket having a body portion defining a plane, the fan motor supported by the body portion of the bracket, the bracket comprising a plurality of bracket attachment elements projecting from the body portion toward the exterior wall and configured for attaching the bracket to the exterior wall of the cooking chamber, each bracket attachment element having a plurality of discrete contact members providing the only contact between the bracket and the exterior wall of the cooking chamber;

a plurality of motor attachment elements, each motor attachment element projecting from the body portion toward the fan motor, each motor attachment element providing the only contact between the motor and the body portion; and a plurality of slots defined within the plane of the body portion of the bracket, the plurality of slots forming two circuits of slots within the plane of the body portion of the bracket, each circuit surrounding the plurality of motor attachment elements, wherein each pair of adjacent slots within a circuit is separated by a gap, and wherein any straight line constructed within the plane between any one of the motor attachments elements and any one of the bracket attachment elements will not intersect more than one gap.

13. The oven appliance of claim 12, wherein each pair of adjacent slots within a circuit is separated by a gap that is shorter in length than either of the adjacent slots.

14. The oven appliance of claim 13, wherein at least a portion of the gaps are not adjacent to another gap within the plane of the body portion of the bracket.

15. The oven appliance of claim 12, wherein any straight line constructed within the plane between any one of the motor attachment elements and any one of the bracket attachment elements will intersect at least one slot.

16. The oven appliance of claim 12, wherein the exterior wall and body portion define an air gap.

17. The oven appliance of claim 16, wherein a block of insulation is positioned in the air gap.

18. The oven appliance of claim 12, wherein the contact members are triangle-shaped and have a single point of contact with the exterior wall.

19. The oven appliance of claim 12, wherein a straight line constructed within the plane between any one of the motor attachment elements and any one of the bracket attachment elements will intersect at least two slots.

20. A bracket for supporting a component on an exterior wall of an oven appliance, the bracket comprising:

a body portion defining a plane, the body portion supporting the component;

a plurality of bracket attachment elements projecting from the body portion toward the exterior wall and configured for attaching the bracket to the exterior wall, each bracket attachment element having a plurality of discrete contact members, each contact member having a single point of contact with the exterior wall, the discrete contact members providing the only contact between the bracket and the exterior wall;

a plurality of component attachment elements integral with the body portion, each component attachment element projecting from the body portion toward the component, each component attachment element providing the only contact between the component and the body portion; and a plurality of slots defined within the plane of the body portion of the bracket, wherein a straight line constructed within the plane between any one of the component attachment elements and any one of the bracket attachment elements is intersected by at least one slot of the plurality of slots.

* * * * *